US011719002B2

(12) United States Patent
Haas

(10) Patent No.: US 11,719,002 B2
(45) Date of Patent: Aug. 8, 2023

(54) FLOORING BOARD SPACING ASSEMBLY

(71) Applicant: Decktec Pty Ltd, Brisbane (AU)

(72) Inventor: Peter Haas, Brisbane (AU)

(73) Assignee: DECKTEC PTY LTD, Brisbane (AU)

( * ) Notice: Subject to any disclaimer, the term of this patent is extended or adjusted under 35 U.S.C. 154(b) by 63 days.

(21) Appl. No.: 16/500,135

(22) PCT Filed: Apr. 10, 2018

(86) PCT No.: PCT/AU2018/050325

§ 371 (c)(1),
(2) Date: Oct. 2, 2019

(87) PCT Pub. No.: WO2018/187837

PCT Pub. Date: Oct. 18, 2018

(65) Prior Publication Data

US 2021/0102384 A1 Apr. 8, 2021

(30) Foreign Application Priority Data

Apr. 12, 2017 (AU) ..... 2017100418
Apr. 12, 2017 (AU) ..... 2017202416

(51) Int. Cl.
*E04F 15/02* (2006.01)
*E04G 21/18* (2006.01)

(52) U.S. Cl.
CPC .. *E04F 15/02022* (2013.01); *E04F 15/02183* (2013.01); *E04F 15/02044* (2013.01); *E04F 15/02166* (2013.01); *E04G 21/1883* (2013.01)

(58) Field of Classification Search
CPC ..... E04F 15/02022; E04F 15/02183; E04F 2015/02066; E04F 21/22; E04F 15/02005; E04F 15/126; E04F 21/0092; E04F 15/02044; E04F 15/02166; E04B 5/023; E04C 3/02; E04G 21/1883
USPC ..... 52/749.1, 105, 127.1
See application file for complete search history.

(56) References Cited

U.S. PATENT DOCUMENTS 3,020,602 A * 2/1962 Siering ..... E04F 13/0816 52/363
3,267,630 A * 8/1966 Omholt ..... E04F 15/04 52/480
3,390,494 A * 7/1968 Chappie ..... E04B 2/56 52/105

(Continued)

FOREIGN PATENT DOCUMENTS

WO 2013190400 A1 12/2013

OTHER PUBLICATIONS

Written Opinion and International Search Report issued in International Application No. PCT/AU2018/050325 dated Jul. 3, 2018, 15 pages.

(Continued)

*Primary Examiner* — Phi D A
(74) *Attorney, Agent, or Firm* — Wegman Hessler

(57) ABSTRACT

A flooring board spacing assembly including an elongate platform member locatable on a flooring joist, the platform member having a plurality of first spacers evenly spaced at regular intervals along the length of the platform member, wherein, in use each of the first spacers separates adjacent flooring boards located on the platform member and forms a predetermined space between the adjacent flooring boards.

15 Claims, 9 Drawing Sheets

(56) References Cited

U.S. PATENT DOCUMENTS 3,903,670 A * 9/1975 Robinson, Jr. ..... E04F 13/0821 52/478
4,594,823 A * 6/1986 Hague ..... E04D 3/3607 403/306
5,870,874 A * 2/1999 Brothers ..... E04B 7/04 52/696
7,028,446 B2 * 4/2006 Winchester ..... E04B 5/12 52/105
7,353,640 B2 * 4/2008 Stutler ..... E04D 3/405 52/100
7,398,620 B1 * 7/2008 Jones ..... E04B 7/045 52/643
8,079,199 B1 * 12/2011 Kufner ..... E04F 13/0892 52/749.11
8,672,600 B2 * 3/2014 Reznar ..... E04F 15/04 52/489.1
9,181,716 B1 * 11/2015 Gibson ..... E04B 1/38
9,297,161 B2 * 3/2016 Zimmerman ..... E04B 1/2612
9,322,186 B1 * 4/2016 Chang ..... E04F 21/22
9,416,546 B2 * 8/2016 Claudin ..... E04B 1/40
10,961,719 B2 * 3/2021 Doupe ..... E04F 15/105
2002/0148129 A1 * 10/2002 Donnellan ..... E04F 15/02022 33/526
2003/0159399 A1 * 8/2003 Werren ..... E04F 21/0092 52/749.1
2004/0250504 A1 12/2004 Leek et al.
2010/0083610 A1 * 4/2010 King ..... B25B 23/005 52/749.1
2012/0090256 A1 4/2012 Andrews
2012/0180422 A1 * 7/2012 Noturno ..... E04G 21/1891 52/696
2012/0227348 A1 * 9/2012 Turner ..... E04F 15/02044 52/582.1
2013/0014465 A1 * 1/2013 Kilgore ..... E04F 15/02183 52/704
2013/0174498 A1 * 7/2013 Hovren ..... E04G 21/1891 52/105
2014/0007525 A1 1/2014 Wright
2014/0260041 A1 9/2014 Peck et al.
2015/0040514 A1 * 2/2015 Hinkle ..... E04F 15/02133 52/745.13
2016/0040439 A1 * 2/2016 Pelc ..... E04F 15/203 52/126.6
2016/0222679 A1 * 8/2016 Bunch ..... E04F 21/1844
2016/0326754 A1 * 11/2016 Bucsa ..... E04F 21/18
2017/0254077 A1 * 9/2017 Andres ..... E04B 1/0038
2018/0238060 A1 * 8/2018 Doupe ..... E04F 15/105
2019/0136546 A1 * 5/2019 Doupe ..... E04F 15/02022
2020/0011073 A1 * 1/2020 Sheppard ..... G01C 9/28

OTHER PUBLICATIONS

Written Opinion issued in International Application No. PCT/AU2018/050325 dated Mar. 12, 2019, 4 pages.

* cited by examiner

FLOORING BOARD SPACING ASSEMBLY

CROSS REFERENCE TO RELATED APPLICATION

This application is a national phase of International Patent Application No. PCT/AU2018/050325 filed Apr. 10, 2018, which claims the priority filing benefit of Australian Patent Application Nos. 2017100418 and 2017202416 filed Apr. 12, 2017, which are incorporated herein by reference in their entirety.

FIELD OF INVENTION

The present invention relates to a flooring board spacing assembly. Reference will be made in the specification to the use of the invention with respect to wooden decking boards. The patent specification describes this use but it is by way of example only and the invention is not limited to this use.

BACKGROUND OF THE INVENTION

Decking boards are typically secured to flooring joists with a space left between adjacent decking boards to allow water to drain from the decking boards, particularly when the decking boards are installed in locations exposed to the elements. The spacing of the decking boards also allows the decking boards to expand due to heat and or humidity.

Currently decking boards are installed by placing a decking board adjacent a secured board, spacing the decking board from the secured board by a predetermined distance and then securing the placed decking board. Typically, a user will use wooden offcuts of a desired thickness to space adjacent decking boards. With the current method of installation, each decking board is installed progressively one at a time, this is a repetitive, laborious and time consuming action.

OBJECT OF THE INVENTION

It is an object of the present invention to overcome or at least alleviate one or more of the above mentioned problems and/or provide the consumer with a useful or commercial choice.

SUMMARY OF THE INVENTION

In one aspect, the present invention broadly resides in a flooring board spacing assembly including an elongate platform member locatable on a flooring joist, the platform member having a plurality of first spacers evenly spaced at regular intervals along the length of the platform member, wherein, in use each of the first spacers separates adjacent flooring boards located on the platform member and forms a predetermined space between the adjacent flooring boards.

Preferably each of the first spacers is removably attached to the platform member. Preferably each of the first spacers extends from a top surface of the platform member. Preferably each of the first spacers is removably attached to the platform member by one or more breakable tabs. Preferably the one or more breakable tabs have a thickness and width that is less than a thickness and width of a corresponding first spacer. Typically, removing the first spacers once the flooring boards are attached to the flooring joist allows the flooring boards to expand without causing unwanted distortion of the flooring boards. In another embodiment, at least a portion of each of the first spacers is made of a different material to that of the platform member. Preferably the portion of each of the first spacers made of a different material to that of the platform member, is located adjacent the platform member. Preferably the portion of each of the first spacers made of a different material to that of the platform member allows the first spacers to be removed from the platform member. More preferably the portion of each of the first spacers made of a different material to that of the platform member allows the first spacers to be pulled from the platform member.

Preferably each of the first spacers has at least one spacing rib extending from a first side thereof and at least one spacing rib extending from a second side thereof. Preferably the spacing ribs aid in spacing adjacent flooring boards. Preferably the at least one spacing rib extending from the first side is offset from the at least one spacing rib extending from the second side. Having the spacing ribs offset from one another allows the first spacer to be slightly twisted to reduce the effective thickness of the first spacer, this can aid in the removal of the first spacer from between two adjacent flooring boards. Preferably there are two spacing ribs extending from the first side of each of the first spacers and two spacing ribs extending from the second side of each of the first spacers.

Preferably each of the first spacers has a recess formed in a top portion thereof. Preferably the recess allows the first spacer to be twisted when located between two adjacent flooring boards.

Preferably the elongate platform member and the plurality of first spacers are manufactured as one item. Preferably the elongate platform member and the plurality of first spacers are made from the same material. In one embodiment, the elongate platform member and the plurality of first spacers are made using at least two different materials. In one embodiment, the elongate platform member and the plurality of first spacers are made from a plastic material. In another embodiment, the elongate platform member and the plurality of first spacers are made of a metal material. Preferably the elongate platform member and the plurality of first spacers are made of aluminium. In a further embodiment, the elongate platform member and the plurality of first spacers are made of a cardboard material or an engineered wood material. Preferably the elongate platform member and the plurality of first spacers are made of a biodegradable cardboard material.

Preferably the platform member is wider than the flooring joist that it is locatable on. Preferably the platform member has flanges extending from the lateral sides of the platform member. Preferably the flanges extend at a downward angle relative to a top surface of the platform member. Preferably the platform member and the flanges inhibit water from collecting on the top of the flooring joist.

Preferably the platform member has a plurality of apertures such that the platform member is attachable to the flooring joist by fasteners. In one embodiment, the apertures extend partially into the platform member. Typically apertures that extend partially into the platform member act as a guide for fasteners.

Preferably the elongate platform member further includes a plurality of second spacers extending therefrom. Preferably the plurality of second spacers are evenly spaced at regular intervals along the length of the platform member. Preferably in use, each of the second spacers is adapted to space two adjacent flooring boards located on the platform member. Each of the second spacers is preferably of uniform thickness. Each of the second spacers preferably extend from the platform member less than each of the first spacers. Preferably each of the second spacers extend from the platform member less than the thickness of a flooring board that is to be located on the platform member. More preferably each of the second spacers extend from the platform member less than half the thickness of a flooring board that is to be located on the platform member. Preferably each of the second spacers is located between two adjacent first spacers. Preferably each of the second spacers is made of the same material as the platform member.

Preferably each of the second spacers has at least one spacing rib extending from a first side thereof and at least one spacing rib extending from a second side thereof. Preferably the spacing ribs aid in spacing adjacent flooring boards. Preferably there are two spacing ribs extending from the first side of each of the second spacers and two spacing ribs extending from the second side of each of the second spacers.

Preferably the flooring board spacing assembly further includes at least one end spacer. Typically, an end spacer will only abut one flooring board. Preferably each end spacer is the same as a first spacer.

Preferably the flooring board spacing assembly further includes an elongate bearer platform. Preferably the bearer platform is locatable between a bearer and the flooring joist. Preferably the bearer platform includes markings indicating predetermined spacing for flooring joists. Preferably the markings include protrusions against which flooring joists can be abutted. Preferably the bearer platform is wider than the bearer that it is locatable on. Preferably the bearer platform has flanges extending from lateral sides of the bearer platform. Preferably the flanges extend at a downward angle relative to a top surface of the bearer platform. Preferably the bearer platform and the flanges inhibit water from collecting on the top of the bearer. Preferably the bearer platform is made of the same material as the elongate platform member.

Preferably the flooring board spacing assembly further includes an elongate fixing jig. Preferably the fixing jig is locatable over the flooring boards and alignable by the plurality of first spacers. Preferably the fixing jig is at least partially insertable into the recess of each of the first spacers. The fixing jig preferably has a plurality of apertures to align a drill bit so that holes can be drilled into the flooring boards at predefined locations. Preferably the fixing jig is made of the same material as the platform member. In one embodiment, the fixing jig is made of a metallic material.

In a further aspect, the present invention broadly resides in a method of installing decking boards, including the steps of locating an elongate platform member on a flooring joist, the elongate platform member having a plurality of first spacers evenly spaced at regular intervals along the length of the platform member;

locating decking boards on the elongate platform member such that each decking board abuts at least one of the plurality of first spacers;

attaching each of the decking boards to the flooring joist; and removing the plurality of first spacers from the platform member.

Preferably the method further includes the step of attaching the elongate platform member to the flooring joist.

Preferably the method further includes the step of locating an elongate fixing jig over the decking boards such that the elongate fixing jig is aligned by the plurality of first spacers.

Preferably the method further includes the step of drilling holes into the decking boards through apertures in the fixing jig.

Preferably the method further includes the step of locating an elongate bearer platform on a bearer prior to the flooring joist being attached to the bearer.

Preferably the step of removing the plurality of first spacers from the platform member includes breaking tabs that connect the plurality of first spacers to the platform member. Preferably the tabs are broken by pulling each of the first spacers from the platform. In another embodiment, the tabs are broken by pushing each of the plurality of first spacers towards the platform member. Once the tabs are broken, each of the plurality of first spacers can be pulled from between adjacent decking boards.

In another aspect, the present invention broadly resides in a flooring board spacing assembly including an elongate platform member locatable on a flooring joist, the platform member having a plurality of first spacers evenly spaced at regular intervals along the length of the platform member, each of the first spacers adapted to separate adjacent flooring boards located on the platform member and form a predetermined space between the adjacent flooring boards;

an elongate bearer platform locatable between a bearer and the flooring joist; and an elongate fixing jig having a plurality of apertures, the fixing jig locatable over the flooring boards such that the elongate fixing jig is aligned by the plurality of first spacers.

The flooring board spacing assembly can also be referred to as a decking board spacing assembly and vice versa. The flooring boards can also be referred to as decking boards and vice versa.

The features described with respect to one aspect also apply where applicable to all other aspects of the invention. Furthermore, different combinations of described features are herein described and claimed even when not expressly stated.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF THE PREFERRED EMBODIMENT

Figure 1:
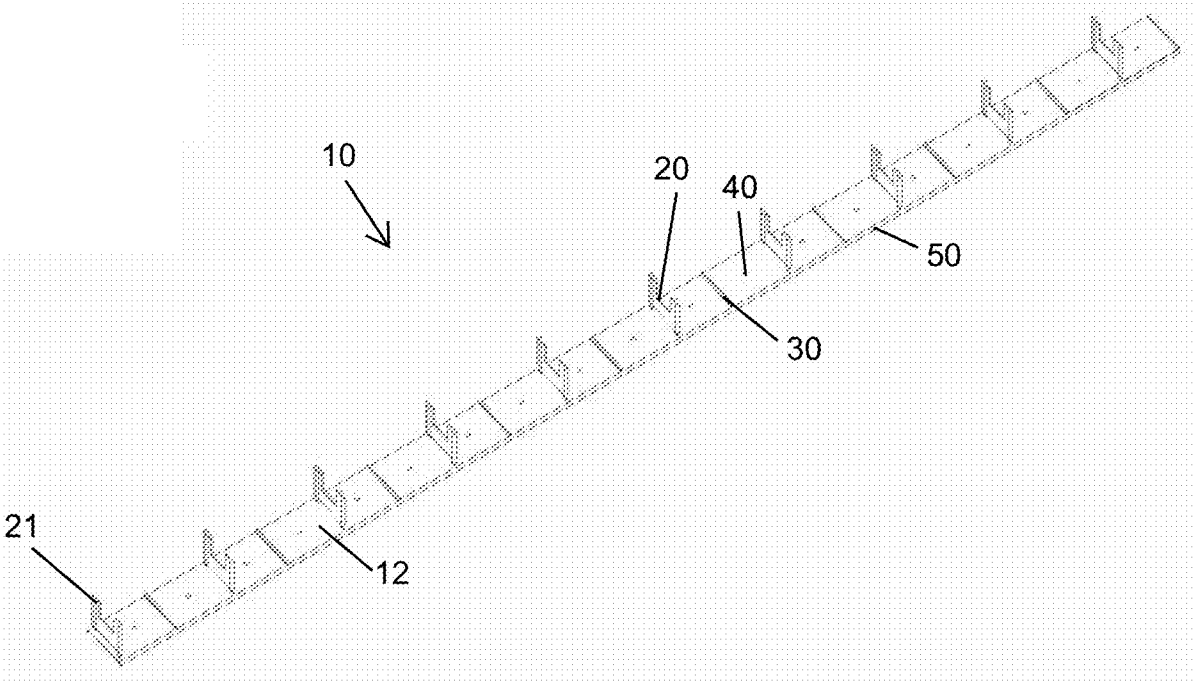
FIG. 1 is a perspective view of a flooring board spacing assembly according to an embodiment of the present invention.
Figure 2:
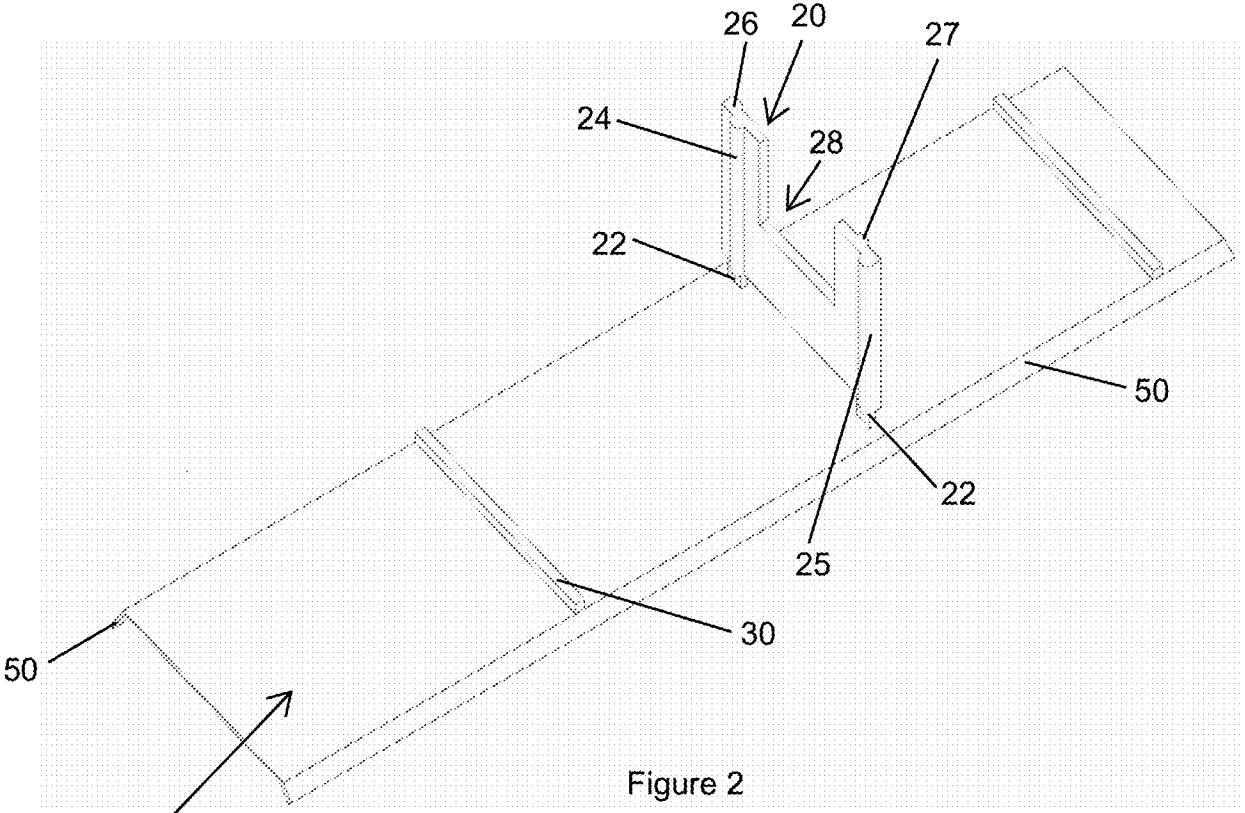
FIG. 2 is a detailed view of the flooring board spacing assembly of FIG. 1.
Figure 3:
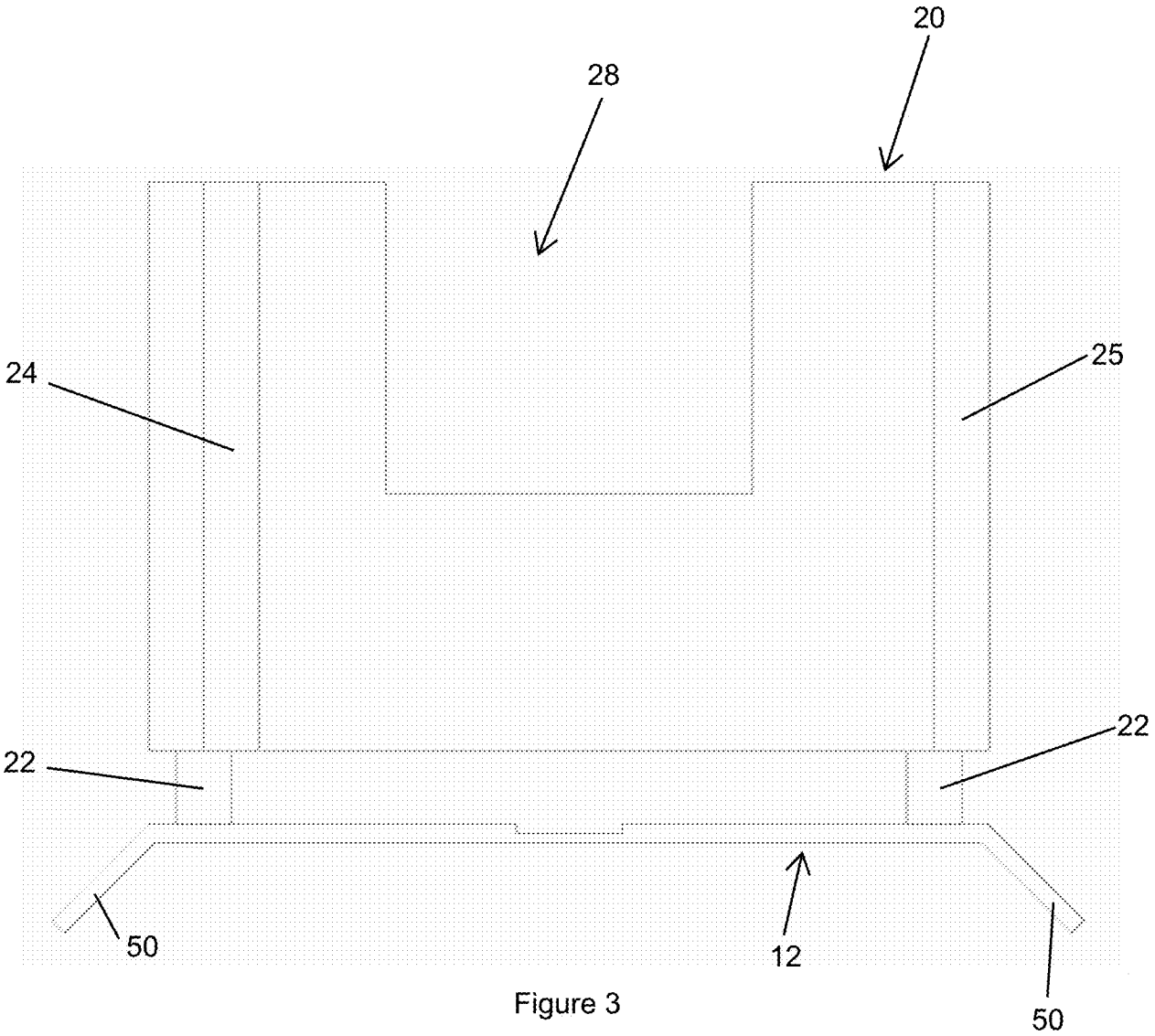
FIG. 3 is a side section view of the flooring board spacing assembly of FIG. 1.
Figure 5:
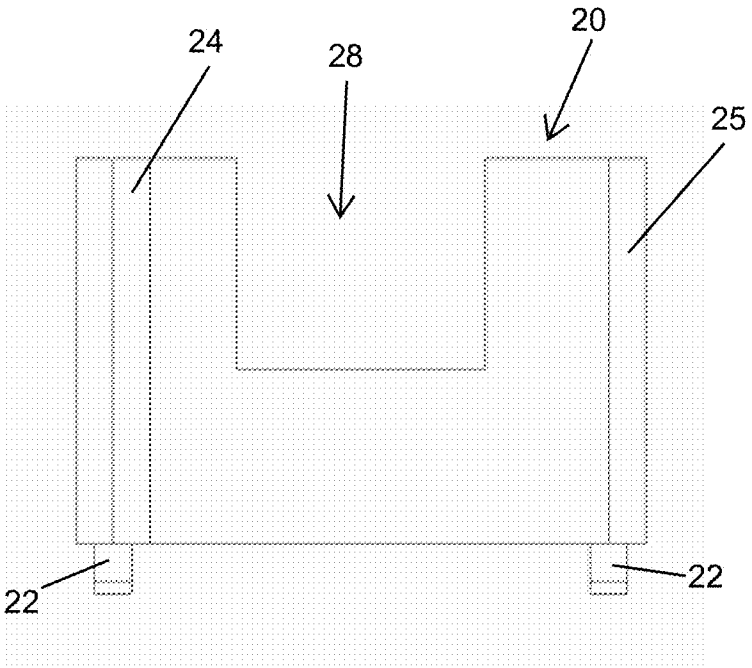
FIG. 5 is a front view of the first spacer of FIG. 4.
Figure 4:
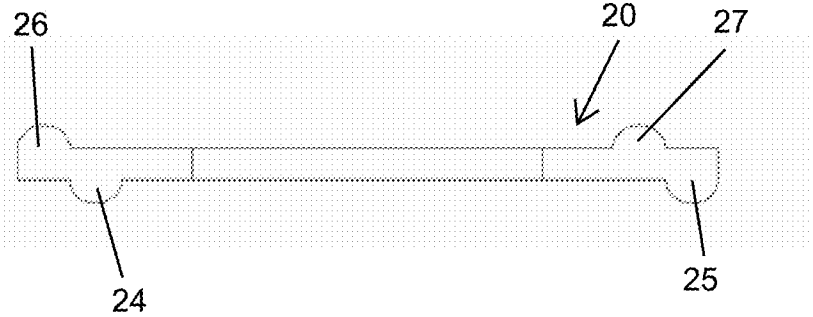
FIG. 4 is a top view of a first spacer of according to an embodiment of the present invention.

With reference to FIGS. 1 to 3, there is shown a flooring board spacing assembly 10. The flooring board spacing assembly 10 has an elongate platform member 12. A plurality of first spacers 20 extend from the platform member 12. An end spacer 21 extends from the platform member 12. The end spacer 21 is the same as a first spacer 20. A plurality of second spacers 30 extend from the platform member 12. The platform member 12 has a plurality of apertures 40 are formed in the platform member 12. The platform member 12 has flanges 50 which extend at a downwardly angle.

The platform member 12 is locatable on a flooring joist (not shown). The top of the platform member 12 and the flanges 50 inhibit water from pooling on the flooring joist. Decking boards (not shown) are locatable on the platform member 12 and spaced from one another by the first spacers 20 and the second spacers 30.

With reference to FIGS. 2 to 5, the first spacers 20 are attached to the platform member 12 by tabs 22. The tabs 22 are thinner than the main portion of the first spacers 20. The tabs 22 allow the first spacers 20 to be removed from the platform member 12. Typically, the tabs 22 break when the first spacers 20 are pulled from the platform member 12.

The first spacers 20 have two spacing ribs 24,25 extending from the first side of the first spacers 20 and two spacing ribs 26,27 extending from the second side. The spacing ribs 24,25 on the first side are offset from the spacing ribs 26,27 on the second side. The first spacers 20 have a recess 28 formed in a top portion thereof.

Figure 6:
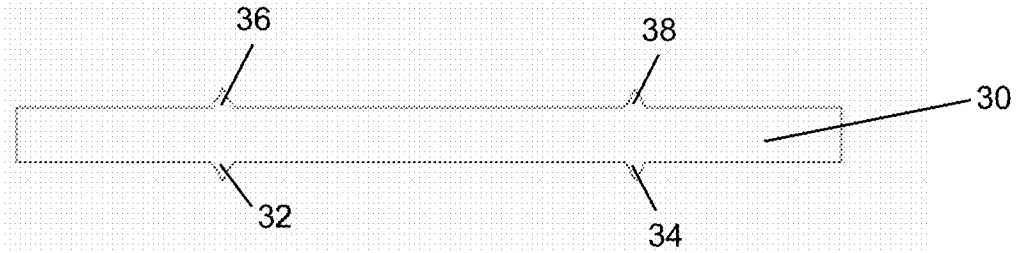
FIG. 6 is a top view of a second spacer according to an embodiment of the present invention.
Figure 7:
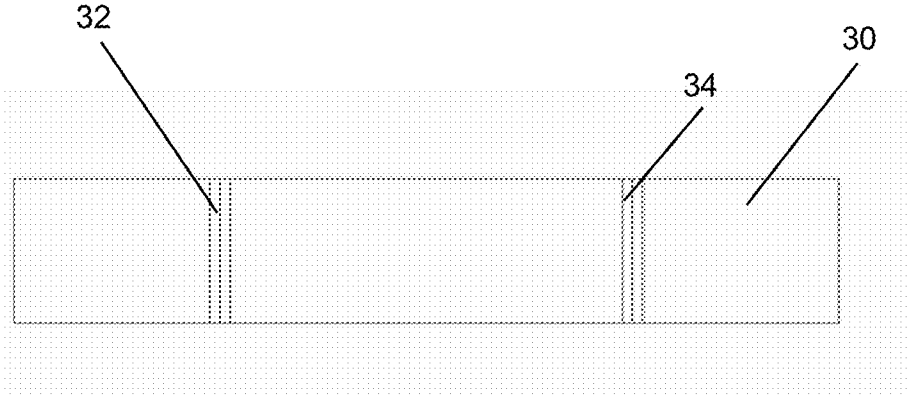
FIG. 7 is a front view of the second spacer of FIG. 6.

With reference to FIGS. 6 and 7, the second spacers 30 have two spacing ribs 32,34 extending from the first side of the second spacers 30 and two spacing ribs 36,38 extending from the second side.

Figure 8:
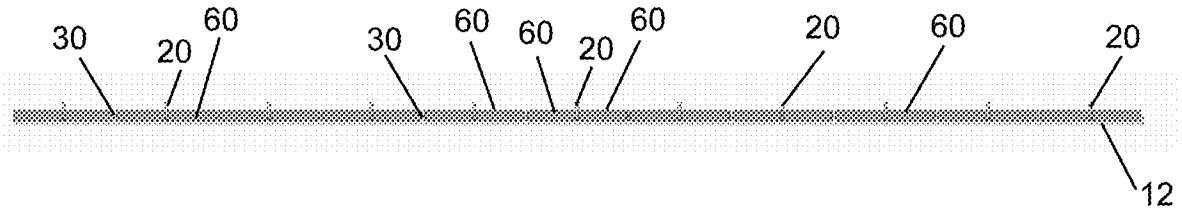
FIG. 8 is a side view of the flooring board spacing assembly of FIG. 1 with decking boards located thereon.

With reference to FIG. 8, there are shown decking boards 60 located on top of the platform member 12. The decking boards 60 are spaced from one another by the first spacers 20 and the second spacers 30. As can be seen in FIG. 8, the height of the second spacers 30 is less than the thickness of the decking boards 60. The first spacers 20 protrude above the thickness of the decking boards 60 so that the first spacers 20 can be pulled from the platform member 12 after the decking boards 60 have been attached to the flooring joist (not shown) and the platform member 12.

Figure 9:
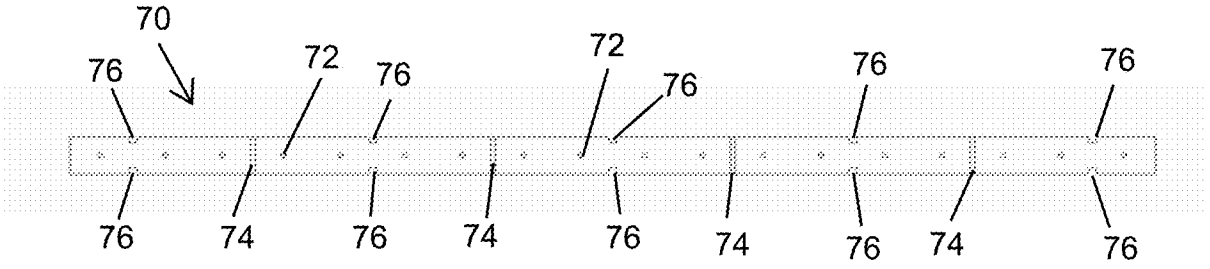
FIG. 9 is a bottom view of a fixing jig of a flooring board spacing assembly according to an embodiment of the present invention.
Figure 10:
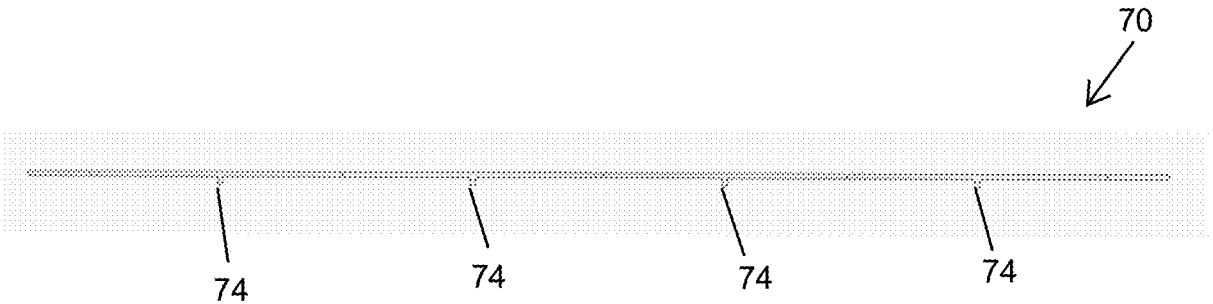
FIG. 10 is a side view of the fixing jig of FIG. 9.

FIGS. 9 and 10 show an elongate fixing jig 70 of a flooring board spacing according to an embodiment of the invention. The fixing jig 70 has a plurality of apertures 72. When the fixing jig is located above a platform member and decking boards (12, 60 as seen in FIG. 8) a drill bit can be aligned with the apertures 72 so that holes can be drilled into the decking boards at predetermined locations. The holes are typically drilled into the platform member and the flooring joist as well.

The fixing jig 70 has protrusions 74. The protrusions 74 can be inserted into spaces between the decking boards to align the fixing jig 70 with the decking boards. The fixing jig 70 also has notches 76. The notches 76 engage with the tops of the first spacers (20 as seen in FIG. 1) to align the fixing jig 70 with the platform member (12 as seen in FIG. 1).

Figure 11:
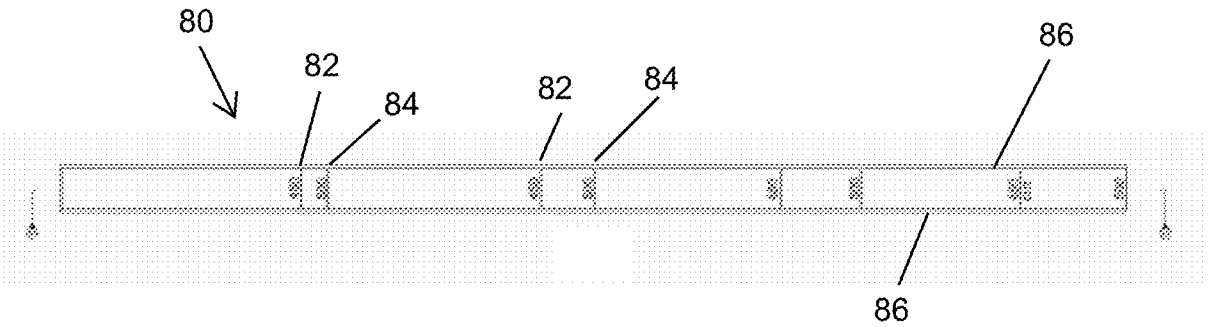
FIG. 11 is a top view of an elongate bearer platform of a flooring board spacing assembly according to an embodiment of the present invention.
Figure 12:
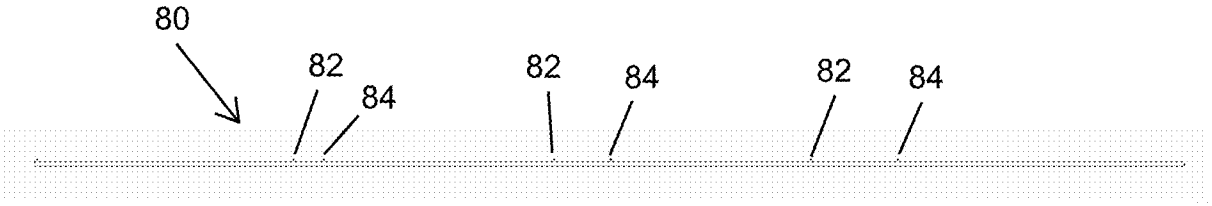
FIG. 12 is a side view of the bearer platform of FIG. 11.

FIGS. 11 and 12 show an elongate bearer platform 80 of a flooring board spacing according to an embodiment of the invention. The bearer platform 80 is locatable between a bearer and a flooring joist. The bearer platform 80 has markings 82,84 indicating predetermined spacings for flooring joists. The markings 82 are spaced at 450 mm and the markings 84 are spaced at 500 mm. The markings 82,84 include a line that extends from the bearer platform 80. Flooring joists can be abutted against the lines of the markings 82,84. The bearer platform 80 further includes flanges 86 extending at a downward angle relative to a top surface of the bearer platform 80. The flanges 86 and the bearer platform 80 inhibit liquid from pooling on top of a bearer.

Figure 13:
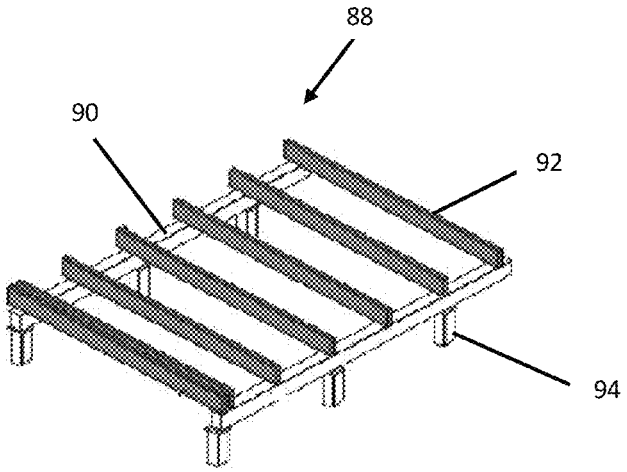
FIG. 13 is a perspective view of a conventional sub-floor framing assembly.

With respect to FIG. 13, there is shown a conventional sub-floor framing assembly 88. The sub-floor framing assembly 88 has a plurality of bearers 90, a plurality of floor joists 92 and a plurality of stumps 94. Bearers 90 and floor joists 92 are the strong foundation underlying timber floors. A bearer 90 is either made from timber or steel and is fixed to stumps 94 sitting on the ground. Floor joists 92 are laid across the bearers 90. Floor joists 92 can be made of timber or steel. Together, the bearers 90 and floor joists 92 create a load bearing, secure frame for the floor structure. This load bearing, secure frame forms the base for a deck.

In use with respect to FIGS. 1 to 12, bearer platforms 80 are located on and attached to bearers (not shown). Flooring joists are located on top of the bearer platforms 80 and aligned with the markings 82 at 450 mm spacings or the markings 84 at 500 mm spacings. The flooring joists are then attached to the bearers.

Platform members 12 are located on and attached to the flooring joists. Decking boards 60 are located on the platform members 12 and spaced from each other by first spacers 20 and second spacers 30.

The fixing jig 70 is located on top of the decking boards 60 and the platform member 12 such that the protrusions 74 are inserted into spaces between the decking boards 60 and such that the notches 76 engage with the first spacers 20 to align the fixing jig 70 relative to the platform member 12. A drill bit is aligned with the apertures 72 and holes are drilled into the decking boards 60, the platform member 12 and the flooring joist. After the holes have been drilled, fasteners in the form of screws, nails or the like are used to attach the decking boards 60 to the platform member 12 and the flooring joist.

After the decking boards are attached to the platform member 12 and the flooring joist, the first spacers 20 are pulled from the platform member 12. Pulling the first spacers 20 from the platform member 12 breaks the tabs 22 attaching the first spacers 20 to the platform member 12. As the spacing ribs 24,25 are offset from spacing ribs 26,27, twisting the spacers 20 can reduce the effective thickness of the spacers 20, making it easier to remove the first spacers 20 from between the decking boards 60. After the first spacers are removed, the decking boards 60 have enough space to expand with an increase in heat and or humidity.

ADVANTAGES

An advantage of the preferred embodiment of the flooring board spacing assembly includes the ability to space multiple flooring boards without having to sequentially space and fix the flooring boards. Another advantage of the preferred embodiment of the flooring board spacing assembly includes accurate spacing between flooring boards. An additional advantage of the preferred embodiment of the flooring board spacing assembly includes allowing the flooring boards to expand after they have been attached to the flooring joist. A further advantage of the preferred embodiment of the flooring board spacing assembly includes protecting the flooring joists from liquids which could pool on the top of the flooring joists and cause damage. Another advantage of the preferred embodiment of the flooring board spacing assembly includes that the flooring boards can be installed by multiple users at the same time.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

The invention claimed is:

1. A flooring board spacing assembly including an elongate platform member locatable on a flooring joist, the platform member having a plurality of first spacers evenly spaced at regular intervals along the length of the platform member; and an elongate fixing jig locatable over the flooring boards and alignable by the plurality of first spacers, the fixing jig having a plurality of apertures to align a drill bit so that holes can be drilled into the flooring boards at predefined locations, wherein, in use each of the first spacers is located between and separates adjacent flooring boards located on the platform member and forms a predetermined space between the adjacent flooring boards, wherein each of the first spacers is removably attached to the platform member by one or more breakable tabs, and wherein each of the one or more breakable tabs has a cross-section that is less than a cross-section of a corresponding one of the plurality of first spacers, and wherein each of the first spacers has a recess formed in a top portion thereof, and wherein the fixing jig is at least partially insertable into the recess of each of the first spacers.

2. The flooring board spacing assembly as claimed in claim 1, wherein each of the first spacers has at least one spacing rib extending from a first side thereof and at least one spacing rib extending from a second side thereof.

3. The flooring board spacing assembly as claimed in claim 2, wherein the at least one spacing rib extending from the first side is offset from the at least one spacing rib extending from the second side.

4. The flooring board spacing assembly as claimed in claim 1, wherein the platform member has flanges extending from the lateral sides of the platform member at a downward angle relative to a top surface of the platform member.

5. The flooring board spacing assembly as claimed in claim 1, wherein the platform member has a plurality of apertures such that the platform member is attachable to the flooring joist by fasteners.

6. The flooring board spacing assembly as claimed in claim 1, wherein the platform member further includes a plurality of second spacers extending therefrom, the second spacers being evenly spaced at regular intervals along the length of the platform member, and wherein in use each of the second spacers is adapted to space two adjacent flooring boards located on the platform member.

7. The flooring board spacing assembly as claimed in claim 6, wherein each of the second spacers extend from the platform member less than the thickness of a flooring board that is to be located on the platform member.

8. The flooring board spacing assembly as claimed in claim 6, wherein each of the second spacers is located between two adjacent first spacers.

9. A flooring board spacing assembly including an elongate platform member locatable on a flooring joist, the platform member having a plurality of first spacers evenly spaced at regular intervals along the length of the platform member, each of the first spacers adapted to separate adjacent flooring boards located on the platform member and form a predetermined space between the adjacent flooring boards;

an elongate bearer platform locatable between a bearer and the flooring joist;

an elongate fixing jig having a plurality of apertures, the fixing jig locatable over the flooring boards such that the elongate fixing jig is aligned by the plurality of first spacers.

10. A method of installing decking boards, including the steps of locating an elongate platform member on a flooring joist, the elongate platform member having a plurality of first spacers evenly spaced at regular intervals along the length of the platform member;

locating decking boards on the elongate platform member such that each decking board abuts at least one of the plurality of first spacers;

attaching each of the decking boards to the flooring joist; and removing the plurality of first spacers from the platform member.

11. The method of installing decking boards as claimed in claim 10, further including the step of attaching the elongate platform member to the flooring joist.

12. The method of installing decking boards as claimed in claim 10, further including the step of locating an elongate fixing jig over the decking boards such that the elongate fixing jig is aligned by the plurality of first spacers.

13. The method of installing decking boards as claimed in claim 12, further including the step of drilling holes into the decking boards through apertures in the fixing jig.

14. The method of installing decking boards as claimed in claim 10, further including the step of locating an elongate bearer platform on a bearer prior to the flooring joist being attached to the bearer.

15. The method of installing decking boards as claimed in claim 10, wherein the step of removing the plurality of first spacers from the platform member includes breaking tabs that connect the plurality of first spacers to the platform member, wherein the tabs are broken by pulling each of the first spacers from the platform.

* * * * *